United States Patent [19]

Crane et al.

[11] Patent Number: 4,600,396

[45] Date of Patent: Jul. 15, 1986

[54] COWL LATCH FOR OUTBOARD MOTORS

[75] Inventors: Paul W. Crane; David W. Kusche, both of Oshkosh, Wis.

[73] Assignee: Brunswick Corporation, Skokie, Ill.

[21] Appl. No.: 562,954

[22] Filed: Dec. 19, 1983

[51] Int. Cl.[4] ..... B63H 21/24

[52] U.S. Cl. ..... 440/77; 292/247

[58] Field of Search ..... 440/77; 16/298, 286, 16/292, 295; 292/246, 247, 113, DIG. 49, DIG. 31; 36/117; 123/198 E, 195 P; 24/69 SK, 68 SK, 70 SK, 71 SK; 441/70

[56] References Cited

U.S. PATENT DOCUMENTS

| | | | |
|---|---|---|---|
| 1,253,658 | 1/1918 | Wilson | 24/68 SK |
| 1,382,322 | 6/1921 | Schleicher | 292/247 |
| 2,756,736 | 7/1956 | Kiekhaefer | 123/198 E |
| 3,182,366 | 5/1965 | Teufel | 24/68 SK |
| 3,404,900 | 10/1968 | Rippetoe | 441/70 |
| 3,773,010 | 11/1973 | Elingsen | 440/77 |
| 3,955,526 | 5/1976 | Kusche | 440/77 |
| 4,074,549 | 2/1978 | Yee | 292/247 |
| 4,142,307 | 3/1979 | Martin | 36/117 |
| 4,300,794 | 11/1981 | Dunsmoor | 292/247 |
| 4,318,557 | 3/1982 | Bourne et al. | 292/DIG. 31 |

*Primary Examiner*—Trygve M. Blix
*Assistant Examiner*—Jesûs D. Sotelo
*Attorney, Agent, or Firm*—O. T. Sessions

[57] ABSTRACT

A latch for the cowl of an outboard motor engine (13) includes a catch (15) mounted on one of the cowl member (12). A lever (19) is pivotally attached to the other cowl member (11) and a resilient spring member (22) is pivotally attached to the lever (19). The lever (19) and spring member (22) act to provide an overcenter action on the lever (19) when the latch is closed. The lever (19) includes a shield (29) to conceal the latch assembly.

5 Claims, 4 Drawing Figures

COWL LATCH FOR OUTBOARD MOTORS

DESCRIPTION

1. Technical Field

This invention relates generally to cowls for outboard motors and more specifically to a latch for a clamshell type cowl.

2. Background Art

Outboard motors generally have their engines enclosed by a cowl assembly. The cowl assembly is constructed to suppress engine noise, protect the engine from water, and protect the users from contact with the engine. One particularly satisfactory type of cowl used for larger engines is a clamshell cowl. Such a cowl has two pieces each hinged at the aft end of the engine and wrapped around the engine side with the forward end of the cowl half connected.

One type of cowl latch for a clamshell cowl is disclosed in U.S. Pat. No. 3,773,010, issued on Nov. 20, 1973. To Elingsen. The Elingsen cowl latch consists of two elastic bands connected between the two cowl halves at the forward end of the cowl. Another latch which has been used on clamshell cowls is disclosed in U.S. Pat. No. 4,216,984 to Hofmann et al, issued on Aug. 12, 1980. The Hofmann latch consists of two interlocking ratchet members which engage each other as the cowl is closed. Yet, another way of latching a clamshell cowl together is disclosed in U.S. Pat. No. 2,756,736 to Kiekhaefer, issued on July 31, 1956. That cowl used a pair of toggle clamps spaced apart vertically and attached to the forward ends of the two cowl halves.

The foregoing cowl latches have all require the use of a separate shield to complete the closure of the engine and to cover the latch members. Further, they all either require the use of two hands or require the manipulation of small parts to operate which can be very difficult under adverse conditions such as cold, wet weather.

DISCLOSURE OF INVENTION

The invention provides cowl assembly for enclosing the engine of an outboard motor and includes a port and a starboard cowl member with a hinge means at the aft end of the cowl members to support them on a generally vertical pivotal axis. A latch assembly at the forward end of the cowl members serves to latch the cowl members together and enclose the engine. The latch assembly includes a catch mounted on one of the cowl members, a lever pivotally attached to the other cowl member and a resilient member pivotally attached to the lever. The resilient member includes a hook for engaging the latch.

The resilient member can include a spring and preferably includes two springs connected by an intermediate portion which forms a hook to engage the latch. The springs can readily be coil springs.

The lever in the latch assembly can have a pivot point fixed on one of the cowl members and the resilient member can have its pivot point fixed on the lever to provide an overcenter action on said lever when the latch is closed. In a preferred embodiment the lever includes a shield which conceals the latch assembly when the cowl members are latched together.

BEST MODE FOR CARRYING OUT THE INVENTION

Figure 1:
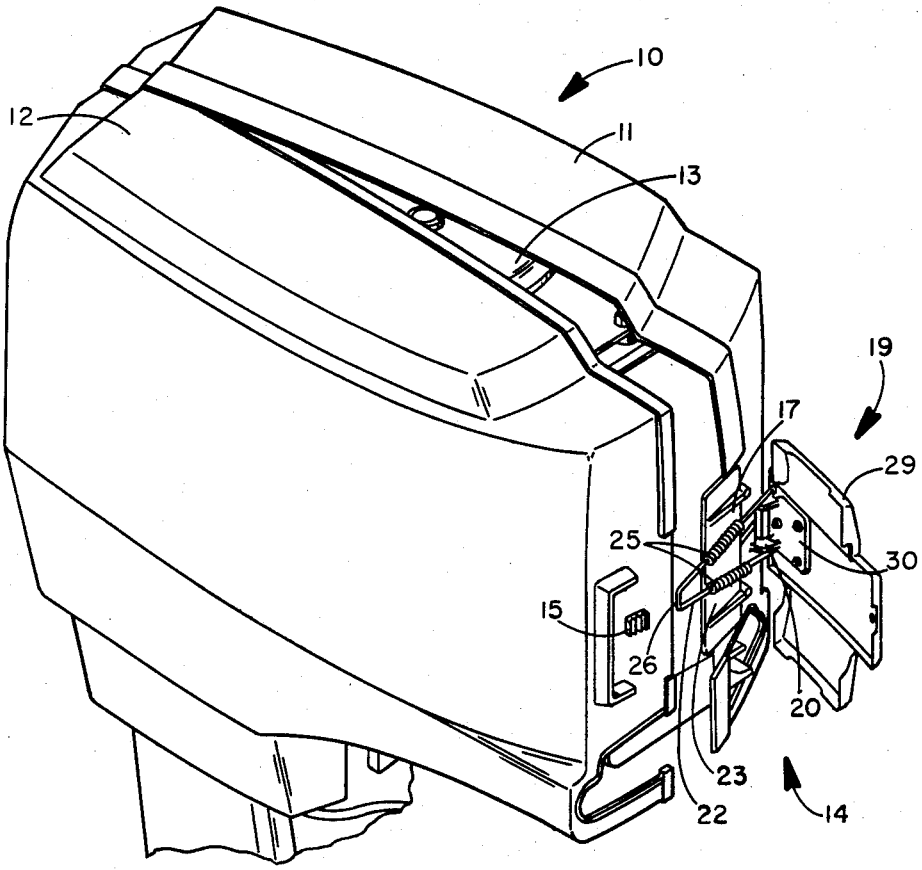
FIG. 1 is a perspective view of an outboard motor incorporating the cowl of the invention with the cowl partially open.

Referring to the drawings, a cowl assembly 10 for enclosing the engine of an outboard motor is illustrated. The cowl assembly 10 includes port and starboard cowl members 11 and 12 which join together to enclose the engine 13. Both of the cowl members 11 and 12 are provided with hinge pins, not illustrated, at the rear which engage a hinge bracket mounted on the aft of the engine to provide a clam shell arrangement like that shown in U.S. Pat. No. 3,955,526 to Kusche, issued on May 11, 1976. In the closed position the forward ends of the cowl members are supported by pins provided on the cowl members which engage support rings mounted on the front of the engine. A latch assembly 14 is provided at the front of the cowl members 11 and 12 to complete the enclosure of the engine 13.

The latch assembly 14 includes a catch 15 mounted by screws 16 on the starboard cowl member 12 and a latch bracket 17 mounted by screws 18 on the port cowl member 11. A latch lever 19 is pivotally mounted on the two arms 20 of the latch bracket 17. A resilient latch member 22 is pivotally attached to the port end of the latch lever 19.

The latch bracket 17 includes two vertically spaced arms 20. The arms 20 are cantilevered toward the port side to accommodate the motion of the latch lever 19. A portion 23 of the latch bracket 17 extends across the center opening of the cowl members 11 and 12 to partially close the gap between the cowl members 11 and 12 when they are latched together. A seal member 24 is held between the latch bracket 17 and the port cowl member 11 to complete the closure.

The resilient latch member 22, formed of a single strand of spring wire, is attached to the latch lever 19 and includes two coil springs 25 connected by a U-shaped segment to form the latch hook 26. At its ends a pair of straight segments 27 are formed to serve as the pivot axis for the resilient latch member 22. A small hook 28 is formed at the end of each of the straight sections 27 to retain the latch member 22 in place.

The latch lever 19 is formed of a latch cover member 29 and a retainer member 30 attached to the latch cover member 29. The two ends of the resilient spring latch member 22 are pivotally attached to the latch cover member 29 by the retainer member 30. Three mounting holes in the retainer member 30 fit over the bosses 31 on the latch cover member 29 to clamp the ends of the latch member 22 in the notches 32 between the latch cover member 29 and the retainer member 30. The retainer member 30 is held in place on the bosses 31 by speed nuts 33. The hooks 28 at the tips of the spring member 22 fit in a notch 34 in the retainer member 30 to prevent them from being pulled out of position. Two pairs of bosses 35 are provided on the retainer member 30 to form a hinge with the latch bracket arms 20.

Aligned holes are provided through the bosses 35 on the retainer member 30 and the latch bracket arms 20 and a roll pin 36 is inserted in the holes in each of the pair of bosses 35 and arms 20 to provide a hinge. The latch cover member 29 is shaped to both conceal the latch machanism and provide an attractively styled front for the outboard motor.

Figure 2:
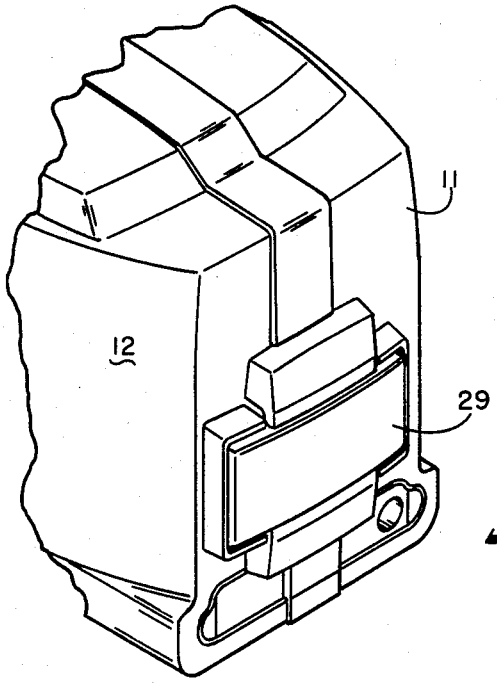
FIG. 2 is a perspective view of the forward portion of the cowl of the invention with cowl closed.
Figure 3:
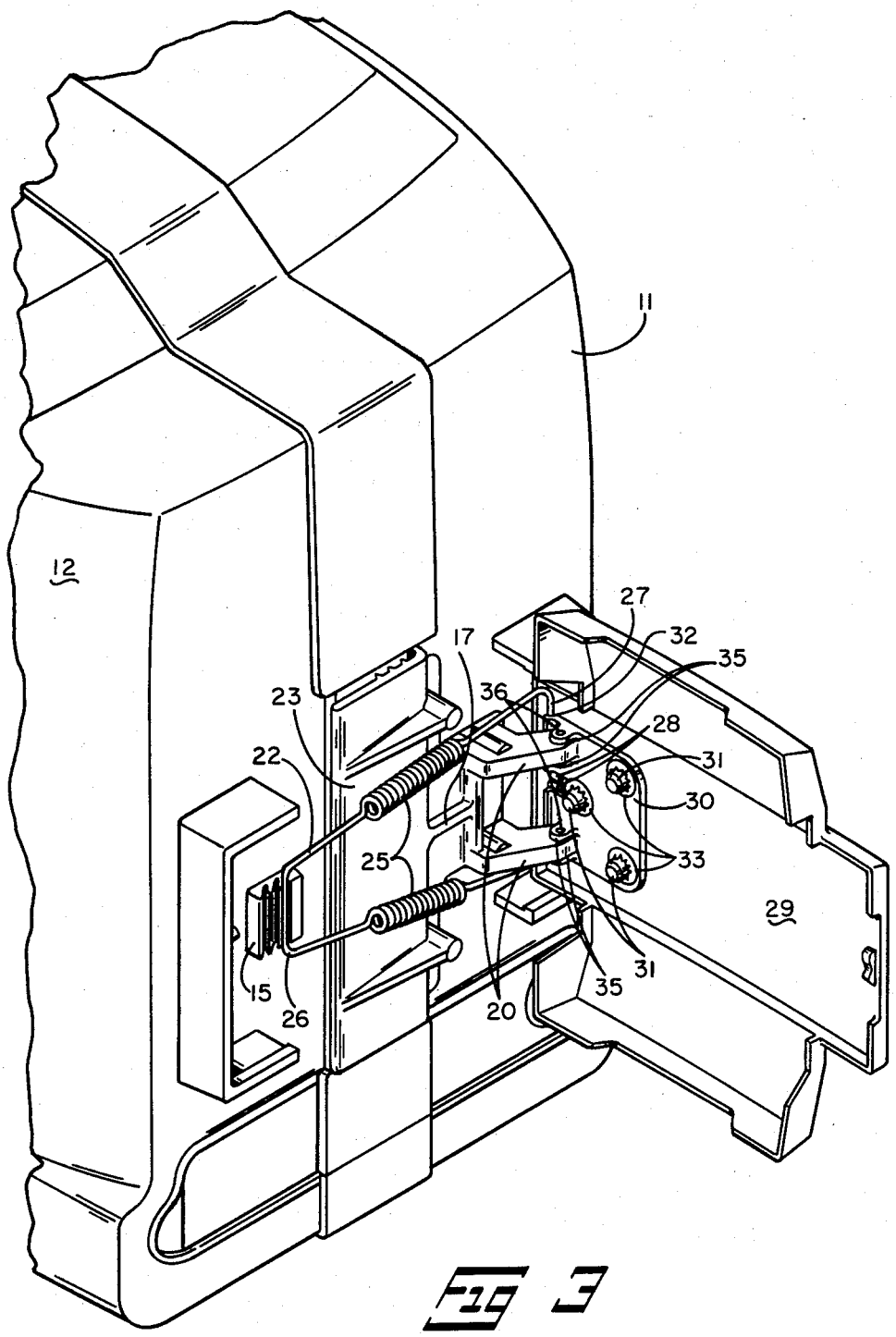
FIG. 3 is a perspective view like that of FIG. 2 but with the latch open.
Figure 4:
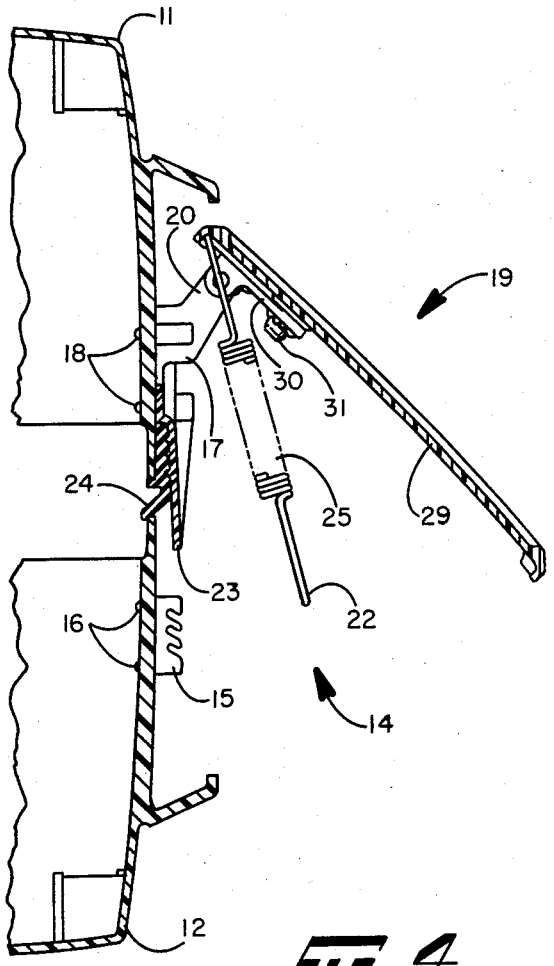
FIG. 4 is a partial sectional view of the latch assembly.

In operation, beginning with the cowl members 11 and 12 open as shown in FIG. 1, the two cowl members 11 and 12 are first brought together and the latch hook 26 engaged with one of the notches in the catch 15. In this position the axis of the resilient latch member 22 crosses between the hinge of the latch lever 19 and the cowl member 11 so that the resilient member 22 tends to pull the latch lever 19 to its open position as shown in FIG. 2. The operator can then push on the outside of the latch lever 19 to close it which will simultaneously move the axis of the resilient latch member 22 across the hinge axis of the latch lever 19 to provide an overcenter action whereby in the closed position the resilient latch member 22 will tend to hold the latch lever 19 closed.

The invention thus provides an attractive latch for an outboard motor cowl which can readily be manipulated under adverse conditions. An operator should have no trouble operating the latch and opening and closing the cowl even wearing gloves.

We claim:

1. A cowl assembly for enclosing the engine of an outboard motor comprising:

(A) a port cowl member;

(B) a starboard cowl member;

(C) a hinge means at the aft end of said cowl members to support said cowl members on a generally vertical pivot axis;

(D) a latch assembly at the forward end of said cowl members for latching said cowl members together to enclose said engine, said latch assembly including (1) a catch mounted on one of said cowl members, (2) a lever pivotally attached to the other of said cowl members said lever having a pivot point fixed on said other cowl member, (3) a resilient member pivotally attached to said lever, said resilient member including a hook for engaging said latch, said resilient member having a pivot point fixed on said lever, said pivot point positioned to provide an over center action on said lever, and (4) a sheild fixed to said lever for concealing said latch assembly when said cowl members are latched together.

2. The cowl assembly defined in claim 1 wherein said cowl members include a rim surrounding said shield.

3. A cowl assembly for enclosing the engine of an outboard motor comprising:

(A) a port cowl member;

(B) a starboard cowl member;

(C) a hinge means at the aft end of said cowl members to support said cowl members on a generally vertical pivot axis;

(D) a latch assembly at the forward end of said cowl members for latching said cowl members together to enclose said engine, said latch assembly including (1) a catch mounted on one of said cowl members, (2) a lever pivotally attached to the other of said cowl members, and (3) a resilient member pivotally attached to said lever, said resilient member including two springs connected by an integral intermediate portion, said integral intermediate portion forming a hook for engaging said catch.

4. The cowl assembly defined in claim 3 wherein said resilient member consists of a single piece of spring wire.

5. The cowl assembly defined in claim 3 wherein said springs are coil springs.

* * * * *